US006480088B2

(12) United States Patent
Okamoto

(10) Patent No.: US 6,480,088 B2
(45) Date of Patent: Nov. 12, 2002

(54) COMMON MODE CHOKE COIL

(75) Inventor: Toshinori Okamoto, Shizuoka-ken (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 09/924,061

(22) Filed: Aug. 8, 2001

(65) Prior Publication Data

US 2002/0017976 A1 Feb. 14, 2002

(30) Foreign Application Priority Data

Aug. 8, 2000 (JP) ..... 2000-239684

(51) Int. Cl.[7] ..... H01F 27/28

(52) U.S. Cl. ..... 336/229; 336/210; 336/84 R; 336/84 M; 336/208

(58) Field of Search ..... 331/84 R, 84 M, 331/210, 211, 229, 225, 65, 206–208

(56) References Cited

U.S. PATENT DOCUMENTS 4,623,865 A * 11/1986 Kiesel et al. ..... 336/65
4,806,895 A * 2/1989 Petrow ..... 336/65
5,828,282 A * 10/1998 Tiemann ..... 336/84 R
6,262,651 B1 * 7/2001 Miyamoto et al. ..... 336/192

FOREIGN PATENT DOCUMENTS

JP 6-5426 * 1/1994

* cited by examiner

*Primary Examiner*—Lincoln Donovan
*Assistant Examiner*—Tuyen T. Nguyen
(74) *Attorney, Agent, or Firm*—Oliff & Berridge, PLC

(57) ABSTRACT

A common mode choke coil is realized in which countermeasures against leakage flux are taken so as to reduce adverse effects on an external apparatus. Coils 291, 292 are wound around a toroidal magnetic core 22 and sandwich a partition plate 27 provided within an inner circumference of the magnetic core so as to cancel out respective magnetic fluxes produced by the coils relative to a normal mode current. A belt-like magnetic shield plate 24 is provided in a direction along leakage fluxes from the coils and attached closely to a substantially U-shaped insulating protection plate 23 having side walls 25, 25 and the insulating protection plate 23 is then detachably attached to a base 21 with catches 26 provided at both ends of the plate 23.

2 Claims, 9 Drawing Sheets

COMMON MODE CHOKE COIL

BACKGROUND OF THE INVENTION

1. Field of the Invention

The present invention relates to a choke coil, and more particularly to a common mode choke coil for removing common mode noise.

2. Description of the Related Art

An alternating-current power supply line constitutes a route through which external noises flow into an electronic apparatus or noises generated inside an electronic apparatus flow out. To cope with this, a choke coil is inserted in series in an alternating-current power supply line for cutting off the noises. There are two kinds of noises; a normal-mode noise generated between lines and a common mode noise generated in both lines relative to the ground, and in general the common mode noise causes problems. A common mode choke coil for removing the common mode noise is required to have a large inductance for the common mode noise and to cause magnetic fluxes to be cancelled out with each other for the alternating voltage of a commercial power supply.

In a case where a toroidal magnetic core is used for a magnetic core of a common mode choke coil, the amount of leakage flux is small with a bifilar winding in which two wires are wound together. However, when a high voltage is applied between two coils, the two coils have to be apart from each other in view of insulation between the coils, and therefore a bifilar winding can not be applied. Thus, it is a common practice that the two coils are wound separately, which causes the following problems.

FIGS. 7A and 7B are a front view and a side view of a conventional toroidal common mode choke coil of vertical type, respectively. FIGS. 8A and 8B are a plan view and a side view of a conventional toroidal common mode choke coil of horizontal type, respectively. In FIGS. 7A, 7B, 8A and 8B, a plastic insulating partition plate 2 is provided within a toroidal magnetic core 1 and attached to an inner circumference of a plastic insulating case 5 housing the toroidal magnetic core 1, and two coils 3*a*, 3*b* wound in the same direction are provided so as to sandwich the plastic insulating partition plate 2. In FIGS. 7A and 7B, the magnetic core 1 is vertically mounted on a plastic base 4, while in FIGS. 8A and 8B, the magnetic core 1 is horizontally mounted on a plastic base 4, and in both cases the respective windings are constructed to lead out from terminals provided on the plastic base 4.

FIGS. 9A and 9B are a plan view and a side view, respectively, showing leakage flux from the toroidal common mode choke coil. As shown in FIGS. 9A and 9B, when an alternating-current power supply current i flows, magnetic poles each having a same pole and a same magnetic potential are generated at a portion A and a portion B of the toroidal magnetic core, respectively, which are ends of the two coils (in the figure, the portion A is shown as an N pole, while the portion B as an S pole).

Due to the generation of the magnetic poles, a part of the magnetic flux turns into leakage flux ΦR travelling from the portion A (N pole) through a space in the vicinity of the toroidal magnetic core to the opposite portion B (S pole). The direction of the generated magnetic flux changes to the direction of current which alternates in accordance with the frequency of a connected power supply. The leakage flux travelling in the space adversely affects peripheral electronic components, in particular, a CRT display or the like thereby disturbing pictures, and lots of efforts have been made for countermeasures.

In order to solve the problem, the mounting position on a substrate of the toroidal common mode choke coil from which the leakage flux is originated is discussed, the coil is entirely covered with a magnetic shield cover, or a magnetic shield plate is provided to cut off the leakage flux when incorporated in an electronic apparatus.

As shown in FIG. 10, a common mode choke coil or the like which generates leakage flux is entirely covered with a magnetic shield cover 7, and the cover is fixed to a base 4. Alternatively, as shown in FIG. 11, a toroidal common mode choke coil 9 generating leakage flux is covered with a magnetic shield plate 10 when mounted on a substrate 8.

FIG. 12 shows an example of a conventional EE-type common mode choke coil. A magnetic core 11 consists of two E-shaped ferrite magnetic cores, and two coils 12*a*, 12*b* are wound around a central bar thereof in phase. Magnetic poles of the two coils generated by an alternating-current power supply current agree with each other at a portion C or portions D, E of the EE-type magnetic core each other, and magnetic fluxes shown by dotted lines designated by Φ1 and Φ2 flow within the magnetic core. Thus, according to the construction of the EE-type common mode choke coil, the amount of magnetic flux leaking outside is smaller compared with the toroidal magnetic core. Therefore, the EE-type magnetic core common mode choke coil is more advantageous in leakage flux than the toroidal common mode choke coil.

As has been described above, the toroidal common mode choke coil is small in size but has a large amount of leakage flux generated, which adversely affects an external apparatus, and as a countermeasure against this, a shield cover, a magnetic shield plate or the like is needed. This pushes up the cost due to materials needed, and therefore an inexpensive and practical countermeasure against leakage flux has been demanded.

Further, although the EE-type magnetic core common mode choke coil is more advantageous in leakage flux than the toroidal magnetic core common mode choke coil, the EE-type magnetic core has a longer magnetic path compared with the toroidal magnetic core, so the number of windings has to be increased in order to gain the same inductance. Due to this, a larger magnetic core and more copper as wire material need to be used. This consumes lots of resources giving a heavier load to the environment for obtaining the same function, and at the same time increases the cost for raw materials. Additionally, the increase in the number of windings increases the winding resistance, resulting in a larger power consumption when the common mode choke is driven. In addition, in the case of the EE-type magnetic core, since a winding is provided on a bobbin in layers, heat generated is confined therein. Moreover, when a common mode choke coil is required to have a large rated current and a large inductance as well, a plurality of such EE-type common mode choke coils need to be connected in series so as to increase the inductance.

SUMMARY OF THE INVENTION

An object of the present invention is to realize a common mode choke coil with solutions to the above problems, which can provide low-cost and practical countermeasures against leakage flux and can eliminate any adverse effect on an external apparatus.

With a view to attaining the above object, according to a first aspect of the present invention, in a common mode choke coil in which one coil is wound around one half of a toroidal magnetic core mounted on a base and another coil is wound around the other half thereof such that the both coils are wound equally so as to cancel out respective magnetic fluxes relative to a normal mode current, a belt-like magnetic shield plate is provided along a direction of leakage flux generated from the two coils so as to reduce the amount of the leakage flux.

According to a second aspect of the present invention, in the common mode choke coil, a partition plate is provided inside the toroidal magnetic core for isolating the two coils from each other, and the belt-like magnetic shield plate is substantially U-shaped and placed in a direction along the partition plate so as to cover the toroidal magnetic core.

According to a third aspect of the present invention, in the common mode choke coil, the magnetic shield plate is attached to an insulating protection plate on a face opposite to a face facing the coils.

According to a fourth aspect of the present invention, in the common mode choke coil, the insulating protection plate to which the magnetic shield plate is attached is detachably attached at both ends thereof to the base on which the toroidal magnetic core is mounted.

According to a fifth aspect of the present invention, in the common mode choke coil, the insulating protection plate to which the magnetic shield plate is attached has side walls provided along the magnetic shield plate.

Since the present invention is constructed as described above, the magnetic shield plate functions to reduce the amount of magnetic flux leaking from the toroidal magnetic core.

Additionally, the insulating protection plate provided between the magnetic shield plate and the coils functions not only to reinforce the magnetic shield plate but also to increase the dielectric strength between the coils wound around the toroidal magnetic core and the magnetic shield plate by providing the side walls which increase the creeping distance.

Then, the ends of the substantially U-shaped insulating protection plate function to allow the plate to be detachably attached to the base.

DETAILED DESCRIPTION OF PREFERRED EMBODIMENTS

Embodiments of toroidal common mode choke coils according to the present invention will be described with reference to the accompanying drawings.

Figure 1A:
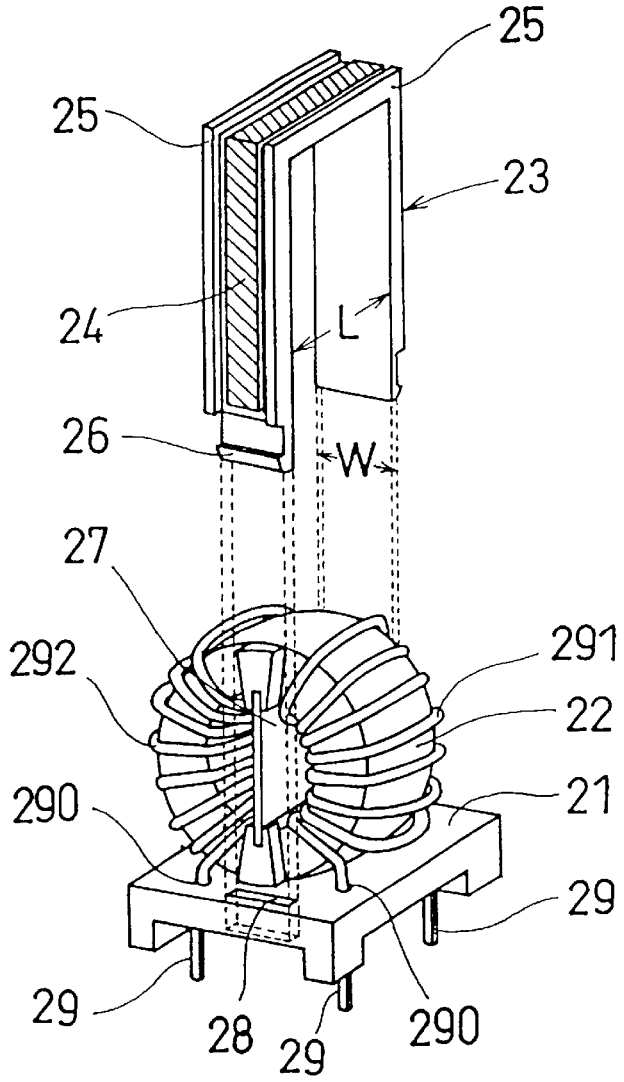
FIGS. 1A and 1B show an embodiment of a toroidal common mode choke coil of vertical type, in which a toroidal magnetic core is covered with a belt-like magnetic shield plate substantially U-shaped and set in a direction along a partition plate.
Figure 1B:
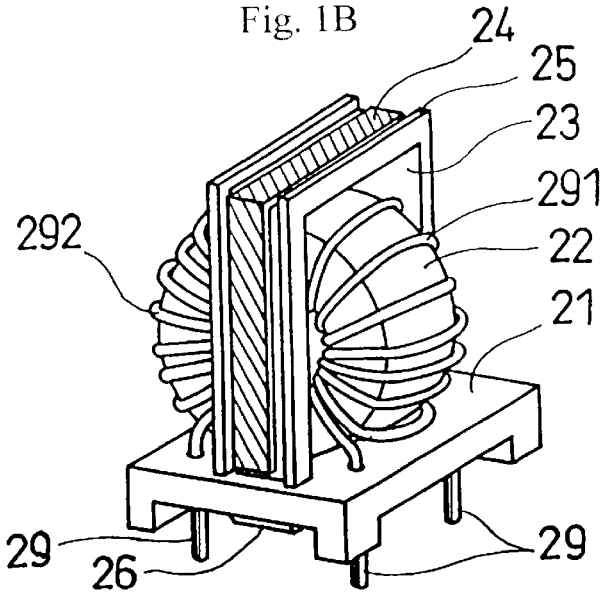

FIGS. 1A and 1B show an embodiment of a vertical type toroidal common mode choke coil. In FIGS. 1A and 1B, coils 291, 292 wound around a toroidal magnetic core 22 are provided so as to sandwich a partition plate 27 formed of, for example, plastic, and provided inside the toroidal magnetic core 22 housed in a plastic insulating case for insulation between lines in order to cancel out respective magnetic fluxes generated by the coils relative to a normal mode power supply current.

A base 21 has two square-shaped insulating protection plate mounting holes 28 (a part not shown), which allows an insulating protection plate 23 to be detachably attached to the base 21.

The insulating protection plate mounting holes 28 are provided to both sides of the magnetic core 22 and adapted to position a magnetic shield plate 24 so that the magnetic shield plate 24 is mounted so as to effectively induce leakage fluxes. Namely, the insulating protection plate 23 to which the magnetic shield plate 24 substantially U-shaped and set in a direction along the partition plate 27 is bonded is assembled as shown in FIG. 1B.

The toroidal magnetic core 22 with the partition plate 27 oriented vertically as shown in FIGS. 1A and 1B is attached to the base 21 with one end of the partition plate 27 fixed thereto by bonding or other methods. The ends of the windings 291, 292 are connected, respectively, to four terminals 29 via four holes 290.

Then, the magnetic shield plate 24 made of a soft magnetic material is tightly secured with an adhesive or the like to the insulating protection plate 23 made of, for example, plastic. The soft magnetic material can be selected from a silicon steel plate, permalloy, ferrite and the like. For a common mode choke coil for commercial power supply lines, the silicon steel plate is used because it has characteristics of magnetic saturation effective in cutting off alternating magnetic fluxes of 50 Hz or 60 Hz and a good cost performance. Of course, an appropriate magnetic shield material may be selected depending on a power supply to be applied. The insulating protection plate 23 is substantially U-shaped, has side walls 25 provided on both sides of the magnetic shield plate 24 and has a certain elasticity, and ends of the insulating protection plate 23 each have a catch 26 adapted to detachably engage with the base 21 by means of the two insulating protection plate mounting holes 28 provided in the base to the both sides of the toroidal magnetic core, and have a width W determined by the width of the magnetic shield plate 24 which is needed to reduce the leakage flux from the coils.

The space between the two rectangular insulating protection plate mounting holes 28 is set so as to be smaller than a distance L between the inner faces of the two ends of the insulating protection plate 23, and the length and width of the insulating protection plate mounting holes 28 are set so as to allow the end of the insulation protection plate 23 to narrowly go therethrough. Consequently, the two catches 26 of the insulating protection plate 23 are pressed inwardly when inserted into the two rectangular insulating protection plate mounting holes 28, then rebound outwardly after the insertion, whereby the insulating protection plate 23 fits securely in the base. When a pressure is applied to the insulating protection plate 23 so as to narrow the distance between the ends of the insulating protection plate 23, the insulating protection plate 23 can be detached from the base 21.

In this embodiment, the plastic insulating protection plate 23 to which the magnetic shield plate 24 is bonded is disposed so as to cover the partition plate 27 provided in the toroidal magnetic core around which the two coils are wound, and is fitted securely in the base 21 by means of the catches 26 thereof. However, the detachable mounting construction is not limited to the above. For example, the plastic insulating protection plate 23 to which the magnetic shield plate 24 is bonded may be secured to the base with screws or may be engaged with projections provided on the base.

Figure 2A:
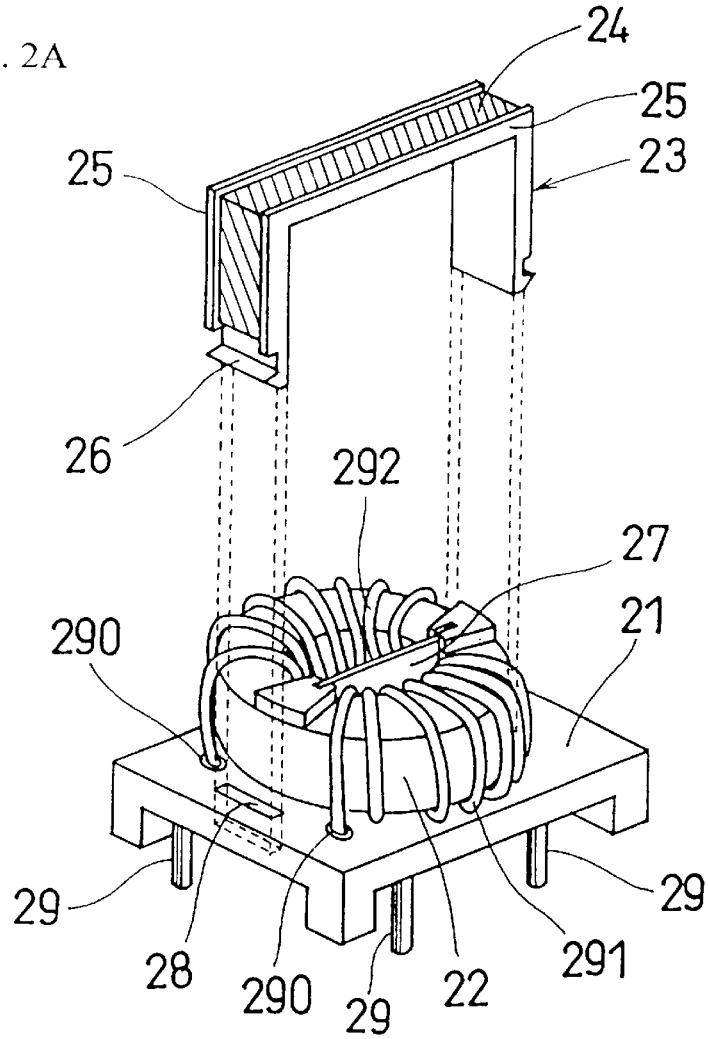
FIGS. 2A and 2B show an embodiment of a toroidal common mode choke coil of horizontal type, in which a toroidal magnetic core is covered with a belt-like magnetic shield plate substantially U-shaped and set in a direction along a partition plate.
Figure 2B:
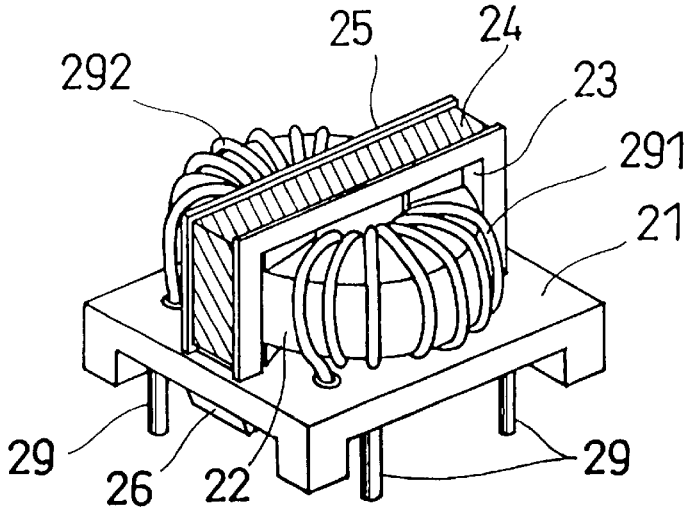

FIGS. 2A and 2B show an embodiment of a horizontal type toroidal common mode choke coil. The embodiment is identical to the embodiment shown in FIGS. 1A and 1B except that a toroidal magnetic core 22 is oriented horizontally and attached to a base 21 with one side of a partition plate 27 fixed thereto by bonding or other methods. With the embodiment shown in FIGS. 2A and 2B, since the height of the common mode choke coil can be kept lower, the common mode choke coil can be strong against horizontal vibrations. Also in the horizontally assembled toroidal common mode choke coil shown in FIGS. 2A and 2B, a plastic insulating protection plate 23 having a magnetic shield plate 24 bonded thereto can be constructed so as to be detachably mounted on the base 21 as in FIGS. 1A and 1B.

Figure 3A:
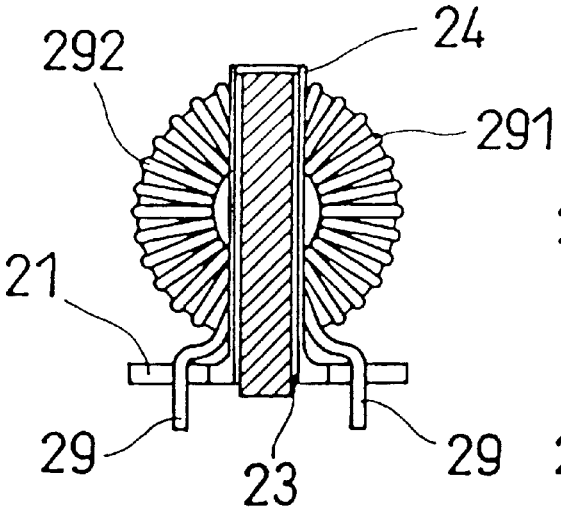
FIGS. 3A and 3B show an embodiment in which a magnetic shield plate is constructed so as to cover entirely the toroidal magnetic core shown in FIG. 1.
Figure 3B:
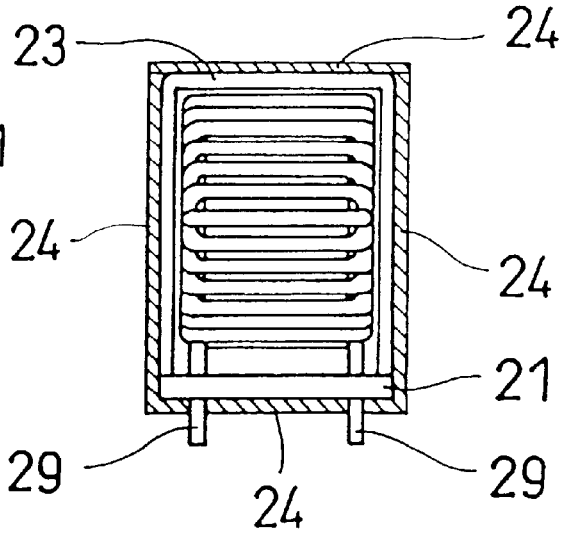
Figure 4A:
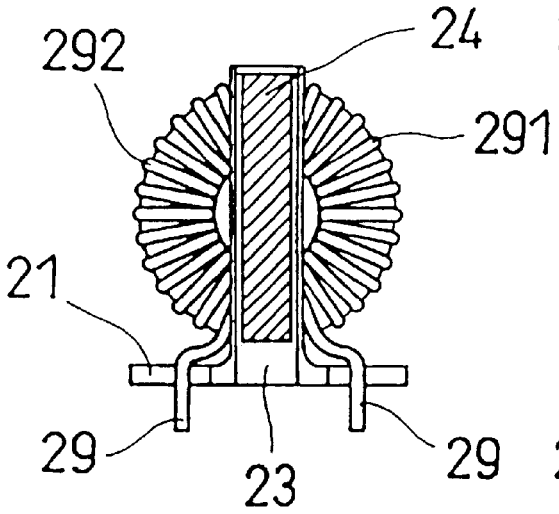
FIGS. 4A and 4B show an embodiment in which a magnetic shield plate is constructed so as to cover partly the toroidal magnetic core shown in FIG. 1.
Figure 4B:
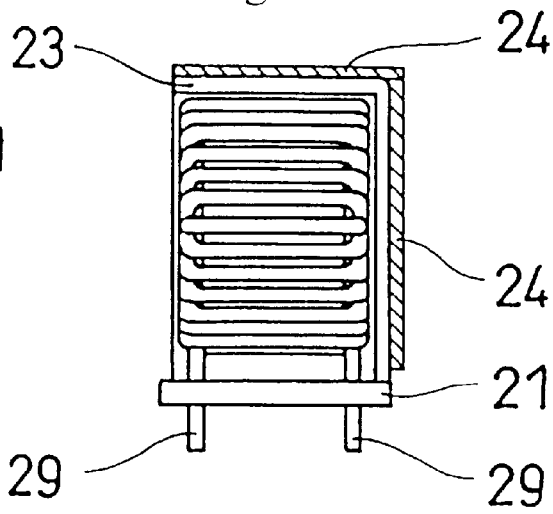
Figure 5A:
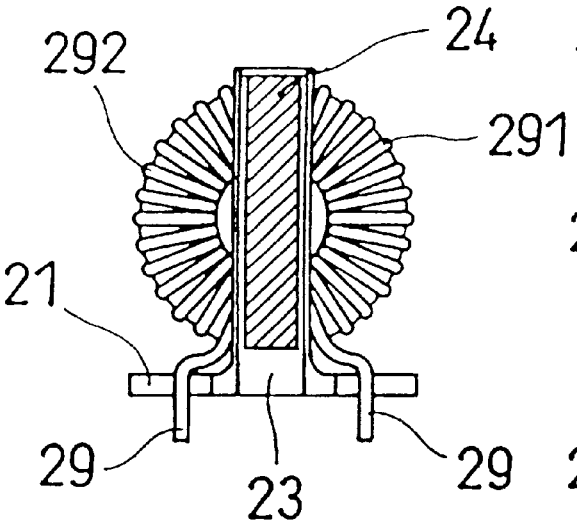
FIGS. 5A and 5B show another embodiment in which a magnetic shield plate is constructed so as to cover partly the toroidal magnetic core shown in FIG. 1.
Figure 5B:
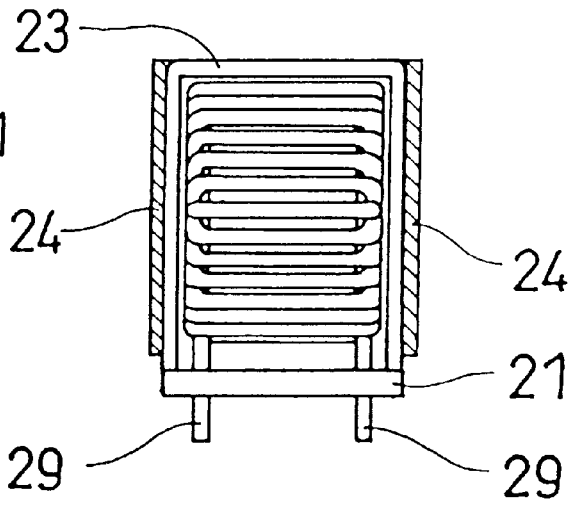

FIGS. 3A and 3B, 4A and 4B, and 5A and 5B show other embodiments of the present invention. In a case where a base 21 is made of an insulating material, a magnetic shield plate 24 is formed in a hollowed square shape or a squared D-shape so as to cover the full circumference of a magnetic core 22 to thereby block leakage flux from under the core as well as shown in FIGS. 3A and 3B.

In this case, first, the substantially U-shaped insulating protection plate 23 without the magnetic shield plate 24 is mounted on the base 21, then the magnetic shield plate 24 is attached to the insulating protection plate 23 and the bottom of the base 21 as well to cover the full circumference of the magnetic core 22 and fixed securely thereto by bonding, screwing or other methods to be connected magnetically to thereby complete the squared D-shaped magnetic shield plate 24.

The embodiment shown in FIGS. 3A and 3B is very effective in reducing leakage flux from the base 21. Additionally, as shown in FIGS. 4A and 4B, and FIGS. 5A and 5B, the magnetic shield plate 24 may be provided only at areas where leakage flux should be prevented, for example, only on the top face and one side face of the insulating protection plate 23 or only on both side faces thereof.

Moreover, in FIGS. 3A and 3B, 4A and 4B, and 5A and 5B, the toroidal magnetic core is oriented vertically, but the toroidal magnetic core can be oriented horizontally in the embodiments.

EXAMPLES

A specific example of the present invention will be described below. In a toroidal ferrite magnetic core having an outside diameter of 19 mm, an inside diameter of 11 mm and a thickness of 5 mm and housed in a plastic insulating cover, one coil was provided around one half of the toroidal magnetic core and another coil was provided around the other half thereof with both coils equally having 40 turns of a copper wire of 0.7 mm in diameter so as to cancel out respective magnetic fluxes from the both coils relative to a normal mode current.

A partition plate was provided inside the toroidal magnetic core for isolating the two coils from each other, and a plastic insulating protection plate including a belt-like magnetic shield plate was provided in a direction along the partition plate so as to cover the toroidal magnetic core. The magnetic shield plate was made of a silicon steel, had a width of 10 mm and a thickness of 0.3 mm and was attached to the insulating protection plate on a face opposite to a face facing the magnetic core.

Figure 6:
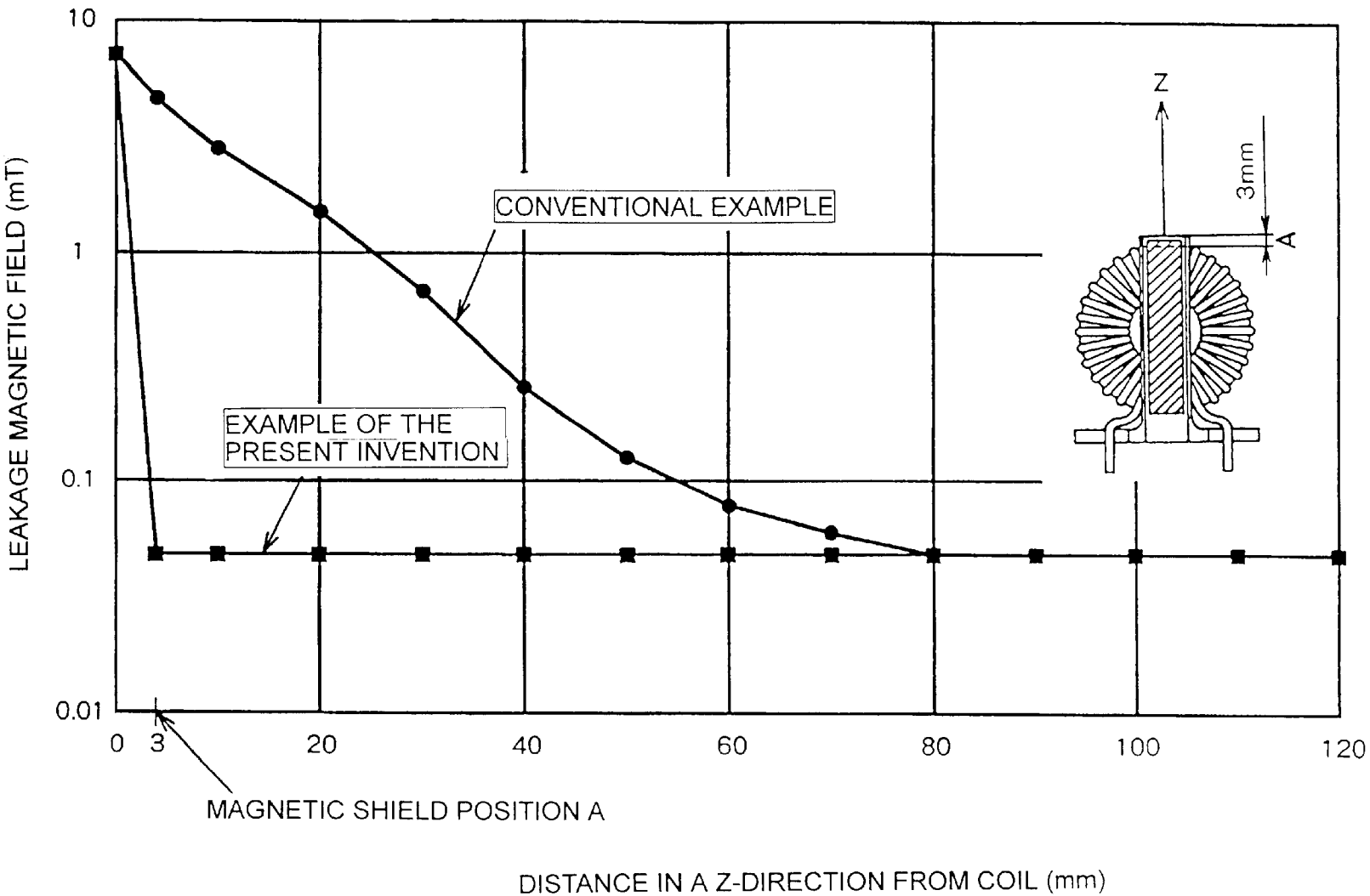
FIG. 6 shows a data actually measured on one of the embodiments.
Figure 7A:
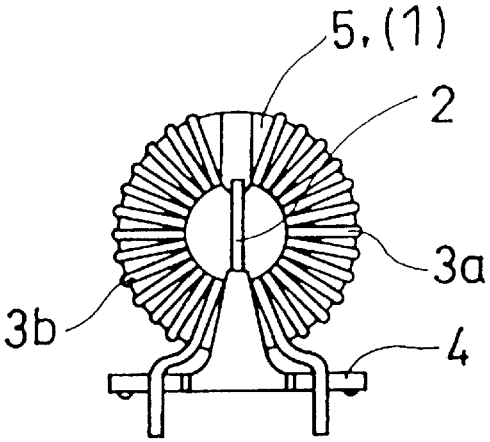
Fig. 7A Prior Art
FIGS. 7A and 7B show one example of a conventional toroidal common mode choke coil of vertical type.
Figure 7B:
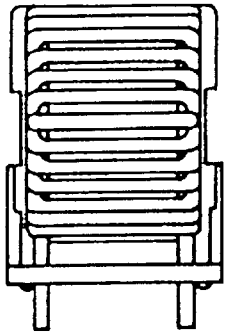
Fig. 7B Prior Art
Figure 8A:
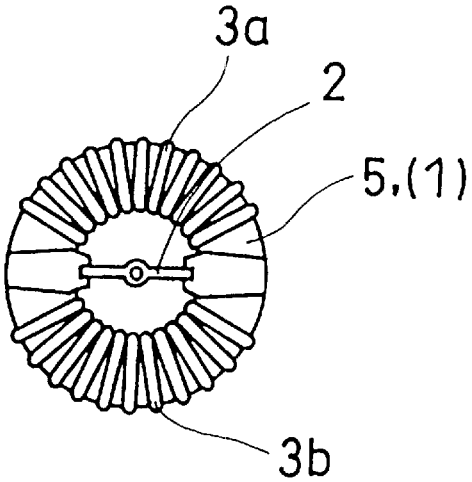
Fig. 8A Prior Art
FIGS. 8A and 8B show one example of a conventional common mode choke coil of horizontal type.
Figure 8B:
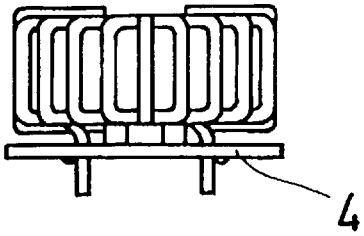
Fig. 8B Prior Art
Figure 9A:
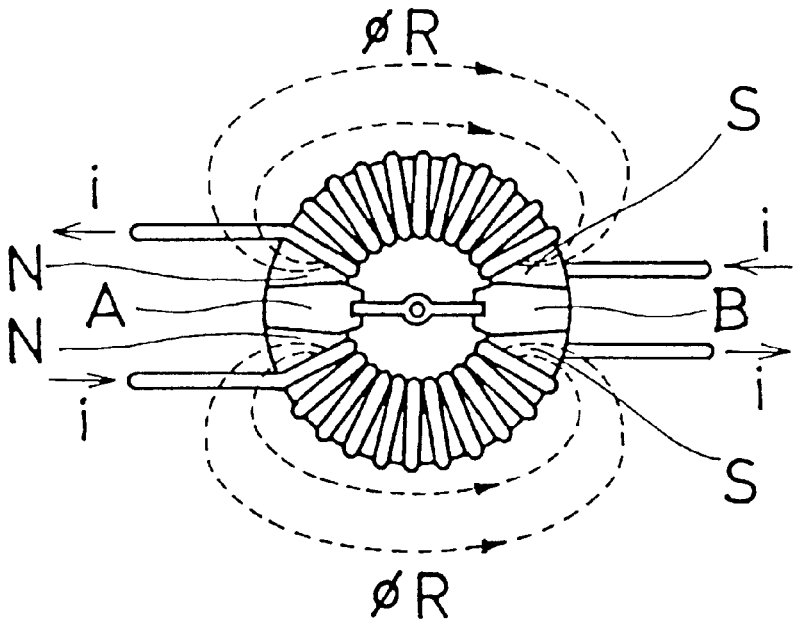
Fig. 9A Prior Art
FIGS. 9A and 9B show explanatory diagrams of leakage flux when a toroidal magnetic core is used.
Figure 9B:
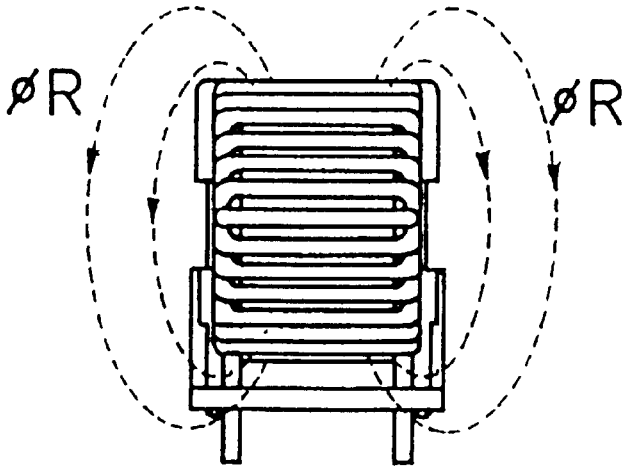
Fig. 9B Prior Art
Figure 10:
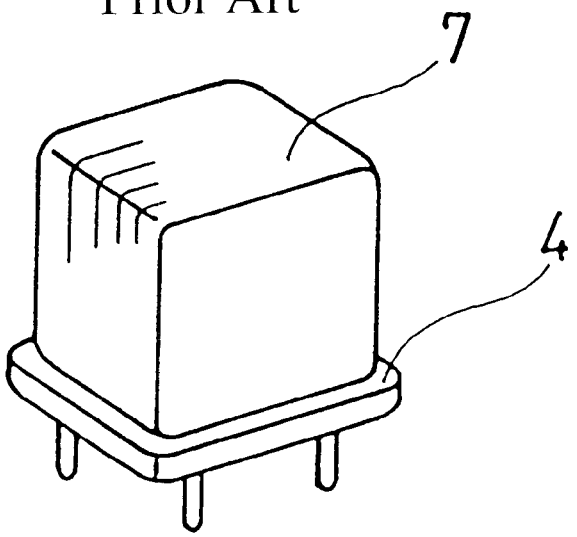
Fig. 10 Prior Art
FIG. 10 shows one example of a conventional magnetic shield.
Figure 11:
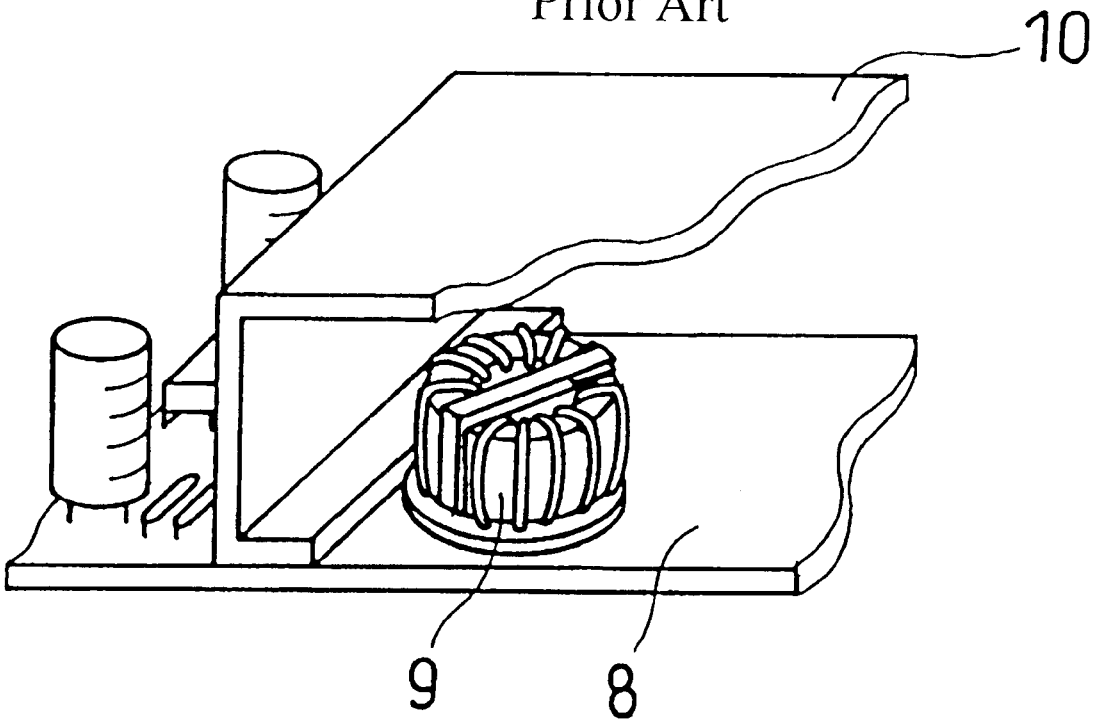
Fig. 11 Prior Art
FIG. 11 shows another example of a conventional magnetic shield.
Figure 12:
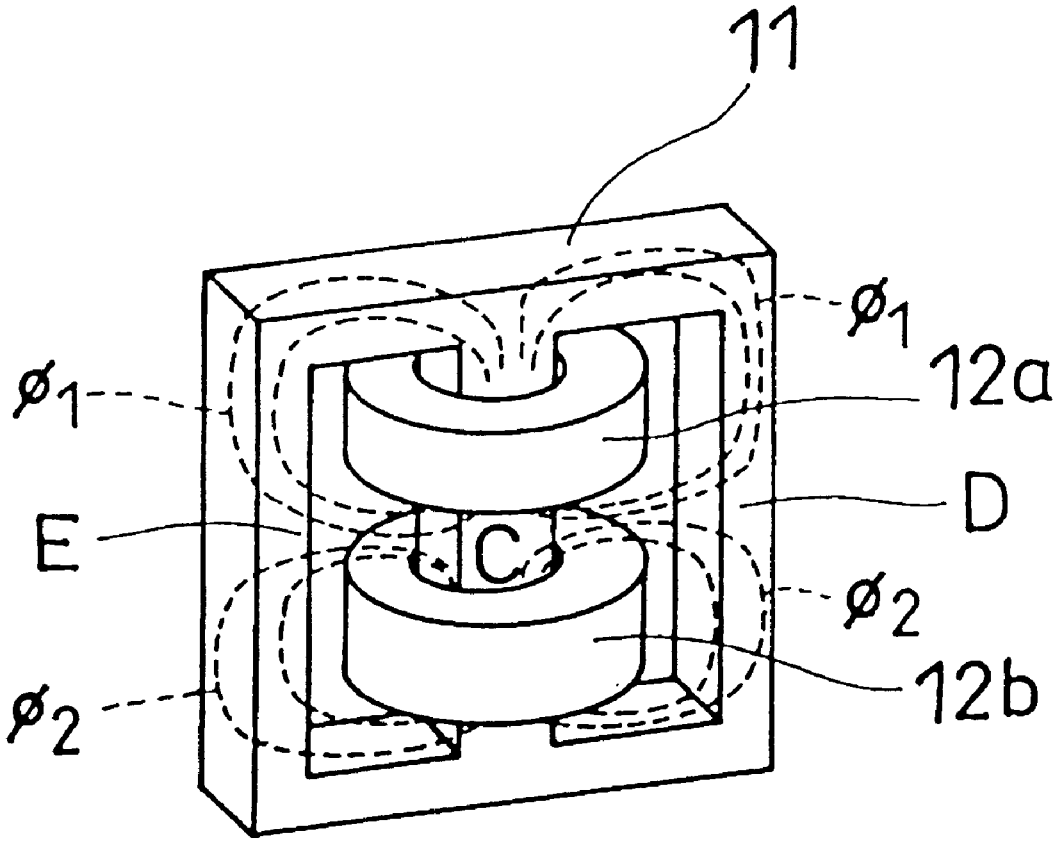
Fig. 12 Prior Art
FIG. 12 shows an explanatory diagram explaining leakage flux when an EE-type magnetic core is used.

There was provided a gap of 3 mm between magnetic poles of the coils and the magnetic shield plate so that the toroidal magnetic core was not magnetically saturated. FIG. 6 is a graph showing the result of measuring leakage flux generated in the space when the toroidal common mode choke coil was excited with a current of 3A by means of the magnitude of magnetic field at a distance from an end face of the coil, that is, in a Z direction, where magnitude of a leakage magnetic field is on ordinate and distance from the coil is on abscissa.

In FIG. 6, with a conventional example without a magnetic shield, the magnitude of a leakage magnetic field moderately reduces as the distance from the coil increases. On the other hand, in the present invention, the magnitude of a leakage magnetic field outside the magnetic shield plate stays constant irrespective of the distance. The conventional example without any magnetic shield has the same magnitude of the leakage magnetic field as the example of the present invention at a distance of 80 mm from the coil, from which it is clear that the example of the present invention has an excellent effect.

The present invention may require some components (such as a magnetic shield material and an insulating material) that are not used in the conventional toroidal common mode choke coil, but is superior in economy and environmental efficiency compared to the countermeasures conventionally taken or the EE-type magnetic core common mode choke coil. Since at least the magnetic shield portion is constructed so as to be detachably mounted at ease, the toroidal common mode choke coil of the present invention can be selectively used depending on requirement of a magnetic shield countermeasure, and it is realized that the common mode choke coil of the present invention has a great effect, especially when compared with EI- or EE-type common mode choke coils.

In other words, in the present invention, since the use of component materials, such as magnetic core, copper wire and bobbin is small, and since there is no need to use a plurality of common mode choke coils in case of a large magnitude of current and a high inductance, resources and energy can be saved and the load to the environment can be reduced, and at the same time cost reduction can be realized. Moreover, since the same performance can be obtained with a reduced number of turns of windings, the resistance of the copper wire can be reduced, and therefore the power consumption can be kept low. The present invention has a great effect especially when used as an AC line filter in which a large current flows, and as a result, a common mode choke coil which is superior in cost performance also with regard to the overall device can be provided.

As has been described above, according to the first aspect of the present invention, in a common mode choke coil in which one coil is wound around one half of a toroidal magnetic core mounted on a base and another coil is wound around the other half thereof such that the both coils are wound equally so as to cancel out respective magnetic fluxes relative to a normal mode current, a belt-like magnetic shield plate is provided along a direction of leakage flux from the two coils so as to reduce the amount of leakage flux. Thus, the adverse effects on an external apparatus can be reduced or eliminated.

According to the second aspect of the present invention, in the common mode choke coil, a partition plate is provided inside the toroidal magnetic core for isolating the two coils from each other, and the belt-like magnetic shield plate is substantially U-shaped and placed in a direction along the partition plate so as to cover the toroidal magnetic core. Thus, magnetic flux leaking from the magnetic core can be absorbed in the magnetic shield plate.

According to the third aspect of the present invention, in the common mode choke coil, the magnetic shield plate is attached to an insulating protection plate on a face opposite to a face facing the coils. Thus, dielectric strength between lines can be improved, and the magnetic shield plate can be reinforced.

According to the fourth aspect of the present invention, in the common mode choke coil, the insulating protection plate to which the magnetic shield plate is attached is detachably attached at both ends thereof to the base on which the toroidal magnetic core is mounted. Therefore, the magnetic shield plate can be selectively mounted depending on the necessity.

According to the fifth aspect of the present invention, in the common mode choke coil, the insulating protection plate to which the magnetic shield plate is attached has side walls provided along the magnetic shield member. Thus, the creeping distance can be increased, and the dielectric strength between the coils wound around the toroidal magnetic core and the magnetic shield plate can be increased. Moreover, the strength of the insulating protection plate can be increased.

What is claimed is:

1. A common mode choke coil, comprising:

a toroidal magnetic core mounted on a base;

two coils wound equally to each other so as to cancel out respective magnetic fluxes relative to a normal mode current, such that one coil is wound around one half of said toroidal magnetic core and another coil is wound around the other half thereof;

a partition plate provided inside said toroidal magnetic core so as to isolate said two coils from each other;

an insulating protection plate formed substantially like U-letter, said insulating protection plate being detachably attached via its both ends to said base for mounting said toroidal magnetic core; and a belt-like magnetic shield plate attached to said insulating protection plate at its surface opposite to a surface facing said two coils, said magnetic shield plate being provided along a direction of leakage flux of said two coils so as to reduce said leakage flux and being placed along said partition plate so as to cover said toroidal magnetic core.

2. A common mode choke coil as claimed in claim 1, wherein said insulating protection plate to which said magnetic shield plate is attached has side walls provided along said belt-like magnetic shield plate.

* * * * *